US008348109B2

(12) United States Patent
Williams

(10) Patent No.: US 8,348,109 B2
(45) Date of Patent: Jan. 8, 2013

(54) APPARATUS AND METHOD FOR SECURING RESIN SET BOLTS WHEN PERFORMING ROCK BOLTING

(76) Inventor: Michael Dene Williams, Kimba (AU)

( * ) Notice: Subject to any disclaimer, the term of this patent is extended or adjusted under 35 U.S.C. 154(b) by 497 days.

(21) Appl. No.: 12/224,737

(22) PCT Filed: Feb. 28, 2007

(86) PCT No.: PCT/AU2007/000235

§ 371 (c)(1),
(2), (4) Date: Aug. 4, 2009

(87) PCT Pub. No.: WO2007/098538

PCT Pub. Date: Sep. 7, 2007

(65) Prior Publication Data

US 2010/0074696 A1 Mar. 25, 2010

(30) Foreign Application Priority Data

Mar. 1, 2006 (AU) ..... 2006901020

(51) Int. Cl.
*B05C 5/00* (2006.01)
*B65D 83/00* (2006.01)

(52) U.S. Cl. ..... 222/567

(58) Field of Classification Search ..... 405/269, 405/259.6, 259.5; 222/527, 533, 566–568; 239/DIG. 12, 588, 269, 602, 195, 175, 169, 239/348

See application file for complete search history.

(56) References Cited

U.S. PATENT DOCUMENTS 2,683,456 A * 7/1954 Pierson ..... 604/215
4,969,604 A * 11/1990 Smith ..... 239/588

* cited by examiner

*Primary Examiner* — Sunil Singh
(74) *Attorney, Agent, or Firm* — Renner Kenner Greive Bobak Taylor & Weber

(57) ABSTRACT

The resin nozzle adapted for storing resin set bolts into ceilings and walls of a mine by injecting a resin sausage into a pre-drilled bolt hole, the said nozzle including: a spring that defines a passage to which resin sausages may be passed there-through; a nozzle tip connectable to the same defined passage, said nozzle adapted to extend into a pre-drilled bolt hole; and a connector member adapted to be fastened onto the tuck bolting equipment to which the resin sausages may be ejected there-from.

11 Claims, 11 Drawing Sheets

APPARATUS AND METHOD FOR SECURING RESIN SET BOLTS WHEN PERFORMING ROCK BOLTING

TECHNICAL FIELD OF INVENTION

This invention relates to rock bolting. In particular this invention relates to securing resin set bolts into the ceilings and walls of a mine or underground tunnel, and even more particular to an actual resin nozzle for injecting a resin sausage into a pre drilled bolt hole.

BACKGROUND ART

In order to access certain valuable ores and other resources underground, it is to often required to first prepare a mine or passage, or some type of underground passageway through rock in order to reach the specific ore to be recovered.

To make the ceiling and the walls of the mine or underground tunnel safe for access, so that further drilling can take place beyond the mine into the ore that has to be resourced, rock bolts and associated pressure plates are used to reinforce the rock.

Conventionally these rock bolts are fixed into the rock that needs to be reinforced by a rock bolter that utilizes a main drill, that bores a bolt hole into the virgin or unsupported rock. The same equipment responsible for boring the bolt hole normally also provides for a bolt driver that is able to insert a bolt into the hole after the drill steel that drills the bore has been removed.

Nonetheless, problems have arisen by simply forcing the bolt into a hole and subsequently securing the bolt with a pressure plate thereto when installing the rock bolt.

The rock where the bolt has been inserted often contains highly corrosive, acidic or salt filled fluids which easily attack the bolt loosening its effect substantially as a reinforcement.

To overcome this problem a new method was created for performing rock bolting whereby a cementing agent is fed into the drill hole that has been drilled into the rock, where upon thereafter a bolt or equivalent is fitted into the drill hole for supporting the rock.

Nonetheless, such methods present further problems, mainly because the hardening of the concrete is relatively slow, and consequently the bolt must be secured into the hole by some mechanical means until the concrete is hardened sufficiently to keep the bolt in the hole. Fortunately however, more recent methods for performing rock bolting have introduced more rapidly hardening adhesives and the like particularly synthetic resins.

When a bolt is to be held in place by resin, the rock bolter drills the bolt hole and is thereafter a resin sausage is placed in the bolt hole. In some instances a series of resin sausages can be inserted. Advantageously, the film or the like enclosing the resin sausage ruptures once the bolt has been inserted into the bolt hole, with this impact allowing the resin to undergo chemical transformation so that bonding can take place between the bolt and the rock.

Presently, to insert these resin sausages into the drilled hole before the bolt is inserted for securing, a reinforced type plastic nozzle hose or guard is used in conjunction with the equipment that provides the drilling of the bore to which the bolt can be driven into.

As one would expect to avoid premature rupturing of the resin sausages, it is necessary to align the resin sausage with the drilled hole prior to insert said sausages into said hole.

Conventionally, to insert the resin sausage, these reinforced plastic type resin nozzles must be moved into alignment with the bolt hole after the hole has been bored by the drill from some distance from the hole itself.

For example, traditional equipment for boring a bolt hole will have an operator operating a drill whose actual impact tip could be at least 10-15 feet away from the operating location.

As the person skilled in the art will appreciate given the operator is at a considerable distance from that location to which the nozzle needs to be aligned, if the sausage is to be inserted correctly into the hole without rupturing, means that the task will be particularly time consuming, difficult and cumbersome.

As is to be expected reinforced plastic though offering some type of resiliency, would still be considered delicate material in the very hard operating conditions of an underground mine tunnel way. The operator who needs to align this plastic nozzle needs to take great care to correctly locate the hole, otherwise damage to the nozzle will be an obvious result.

Once the nozzle becomes damaged, it will no longer be possible to accurately shoot or insert the sausages there through the nozzle correctly into the bolt hole.

If the nozzle becomes damaged the operator will then need to access to the site of the hole, which can present safety risks and/or can delay the bolt setting operation.

This problem becomes even further apparent when the rock bolting system for reinforcing the ceiling or walls of the mine also includes meshing.

Again, as the person skilled in the art will appreciate the meshing provides additional security for those operating in the passageway to which rock bolting has been completed.

However, the introduction of the meshing during the reinforcement of the rock, makes it even more difficult to appropriately align the nozzle with the drill hole so that the resin can be inserted.

The reason being is that the mesh will be of a certain dimension and consequently will provide a passage which will not necessarily overlap directly with the hole, which means the nozzle has to be inserted at an angle or at some type of incline which can provide for an opportunity of kinking or damaging of the nozzle, which as explained above if such damage is created, the nozzle itself becomes unsuitable for further use, and therefore must be replaced.

Therefore, there remains a need in the relevant art for a device for installing resin bolts into the ceiling and walls of a mine, which can utilize a resin nozzle that has greater efficiency and ease of use for an operator who needs to operate the equipment from some distance to which the resin nozzle needs to be aligned, and also is often subjected to aligning the nozzle into a drilled hole that has also already been covered at least part thereover by meshing type equipment.

Consequently an object of this invention is to provide for a resin nozzle for injecting a resin sausage into a pre drilled bolt hole of which overcomes the introduced problems and shortcomings above.

Further objects and advantages of this invention will become apparent from a complete reading of this document.

SUMMARY OF THE INVENTION

Accordingly there is provided in one form of the invention a resin nozzle adapted for storing resin set bolts into ceilings and walls of a mine by injecting a resin sausage into a pre-drilled bolt hole, the said nozzle including:

- a spring that defines a passage to which resin sausages may be passed there-through;
- a nozzle tip connectable to the same defined passage, said nozzle adapted to extend into a pre-drilled bolt hole; and a connector member adapted to be fastened onto the rock bolting equipment to which the resin sausages may be ejected there-from.

An advantage of such and arrangement is that the introduction of the spring as essentially the main body of the nozzle provides for an apparatus that is structurally simple to prepare.

The spring by virtue, of the windings are adapted to be laterally flexible such that where the nozzle is not directly underlying the pre-drilled hole, rather than having the nozzle tip damaged by literally boring into a rock surface, the nozzle is able to flex and therefore take away the pressure upon the nozzle tip as it collides into bare rock at times and the operator has not been able to locate the pre-drilled bolt hole.

Arguably, the inherent characteristics of a spring by virtue of being made up of the series of winds along its vertical axis provides also a level of ability to absorb vertical impact such that when the nozzle inadvertently collides with rock or related material.

This simplified structural embodiment of the invention with the introduction of just the central spring which defines the main passage to which the resin sausages can be passed there-through and then onto the nozzle tip, means that in circumstances when the operator is having difficulties finding or locating the pre-drilled bolt hole in order to inject the resin sausage up there-to, and inadvertently makes impact with solid rock with the nozzle, the nozzle is able to absorb such an impact rather than bending, kinking or becoming deformed.

Advantageously, as damage can now be reduced if mutual placement of a nozzle to locate the pre-drilled hole has gone wrong, means that damage is avoided, and there-by the operator now no longer needs to place themselves in the risk by accessing the site of the drill hole, each as explained in the earlier Provisional Patent Application, can present its own safety risks or at least delay to the bolt setting operation.

In preference the resin nozzle is adapted for installing resin set bolts into ceilings and walls of a mine by injecting a resin sausage into a pre-drilled bolt hole further includes a nose cone. Preferably this nose cone is of the form so as to readily mate with the nozzle tip at one end and the main body spring at the other end.

Preferably this mating relationship between the nozzle tip and the nose cone support is achieved through a mating thread, with relatively wide turns or windings.

Still even further, the mating relationship between the nose cone interconnecting the nozzle tip with the main body spring, when engaging with the main body spring has a threaded arrangement such that the threaded pattern appearing on the nose cone is of a substantially similar dimension to the turns or winds of the main body spring.

An advantage of such an arrangement is that the resin nozzle can be assembled and in fact dissembled without any great skill, or without the requirement of specialised tooling or operator skill.

Advantageously by having wide threading, this ensures that the device can be easily cleaned, but also efficiently and conveniently interconnected. By having the turns or the winds of the spring matching the inner threading arrangement of the nose cone means that no intermediate interconnecting member or tool is required. The spring can be directly connected onto the nose cone, which then also then directly interconnects onto the nozzle tip.

Preferably at the other end of the spring, which really defines the main body of this resin nozzle in this particular further embodiment of the invention, there is a support member, which interconnects or allows the resin nozzle to be easily to mounted onto the operating equipment that is responsible for injecting the resin sausages into the pre-drilled bolt hole. This support member may also preferably include a boss member of which assists in the connection of the nozzle tip onto the operating equipment for injecting the resin sausages.

Within the defined passage created by the main body spring which interconnects by virtue of the nose cone and the support member to complete the entire passage of the resin sausage through the device, a reinforced plastic tube can make its way through this defined passage, of which preferably said guide tube can be placed there-through this defined passage.

In another form of the invention there is provided a resin nozzle adapted for installing resin set bolts into ceilings and walls of a mine by injecting a resin sausage into a pre drilled bolt hole, said nozzle including;

a main body that defines a passage to which resin sausages may be passed there through;

a compression spring adapted to absorb vertical impact when said nozzle inadvertently collides with rock or related material to be reinforced during alignment of said nozzle with pre drilled bolt hole;

a tension spring adapted to allow the main body to be laterally flexible such that damage to said nozzle is substantially avoided in instances where said nozzle is not able to be in direct underlying vertical access alignment with the pre drilled bolt hole.

In preference, the nozzle has a terminating feeding end or funnel that is separated by tapered section from the main body, so as to centralize and guide only the funnel end into the pre drilled bolt hole.

In preference, the tapered ends is a cylindrical shoulder of which contains a series of holes to which back pressure can be exhausted therefrom.

The tapering separating the funnel or the end of the nozzle down to the shoulder which includes there along the back pressure holes, means that the nozzle itself is not able to be inserted too far into the pre drilled bolt hole, so that the exhaust holes will not be covered up.

In the prior art the current reinforced plastic type nozzle randomly places the exhaust holes along the main barrel or passage of the device. As there is no tapering effect along the nozzle itself, it is possible for such conventional nozzles to insert themselves substantially up into the pre drilled holes. Once the nozzle barrel has been inserted into the pre drilled hole and the exhaust holes are covered, the back pressure will be such that any further injection or insertion of the sausages will be forced back into the barrel of the nozzle.

Advantageously, for the arrangement provided for in this invention, the exhaust holes are drilled through the nozzle barrel below the tapered shoulder which provides for a funnelling type effect at the feed end of the nozzle separating the holes from access to the drill hole.

Preferably, the funnel at the feed end of the nozzle would be comparable to those of the pre drilled hole with the main barrel portion beyond the tapered section of dimensions slightly larger so as to prevent movement of the nozzle beyond the terminating opening of the pre drilled holes.

Preferably, the passage defined by the main body includes a resilient tubular barrel type arrangement to which the resin sausages can be guided there through.

Preferably, the compression and tension springs are integrally arranged with the tubular passage of resilient material passing circumferentially inwards of the windings making up the respective springs.

An advantage of such an arrangement is that extra precaution is taken in guiding the resin sausages through the nozzle. This is to avoid inadvertent rupturing of the sausage within the nozzle as it makes its way through the passage provided for by the main body, by including a resilient plastic type barrel the resin sausage can be guided safely there through the compression and tension springs without coming into any direct contact.

In preference, the funnel is replaceable from said nozzle.

An advantage of such an arrangement is that as is to be expected in the harsh environment of an underground mine, the continual impact of the funnel against rock to be reinforced means that whatever material is used it will ultimately be sacrificed.

Advantageously, by having the funnel replaceable, if it is damaged or slowly begins to wear and tear, it can be replaced with a new funnel then being inserted into the main body. Hence, the whole nozzle does not need to be discarded if the tip or funnel becomes damaged at the time.

In preference, the nozzle is made of reinforced steel or other high impact resilient metals or alloys thereof.

In order to now understand the invention more fully preferred embodiments will be provided for with the assistance of the following illustrations.

BRIEF DESCRIPTIONS OF THE DRAWINGS

Figure 6A:
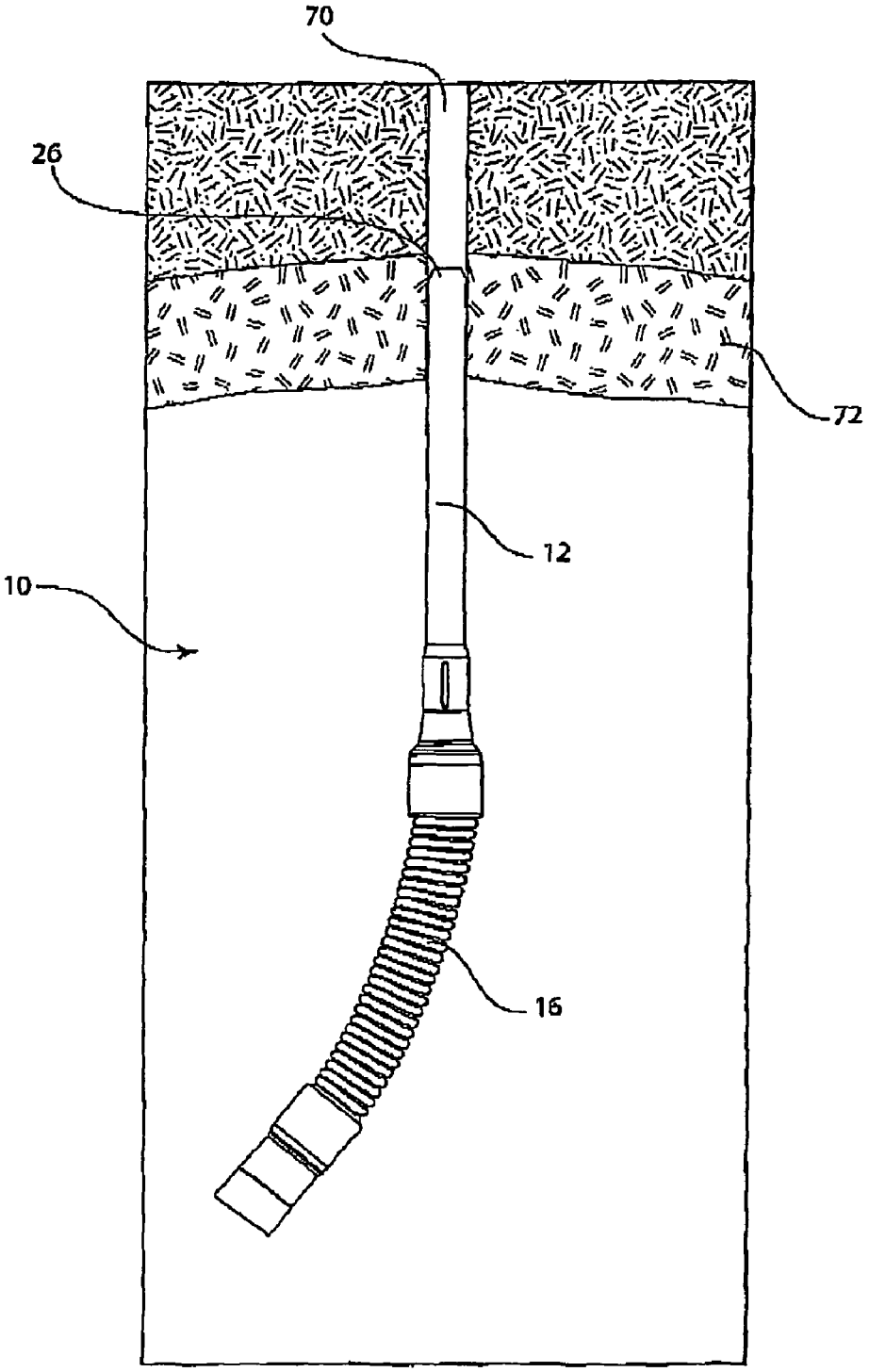
Figure 6B:
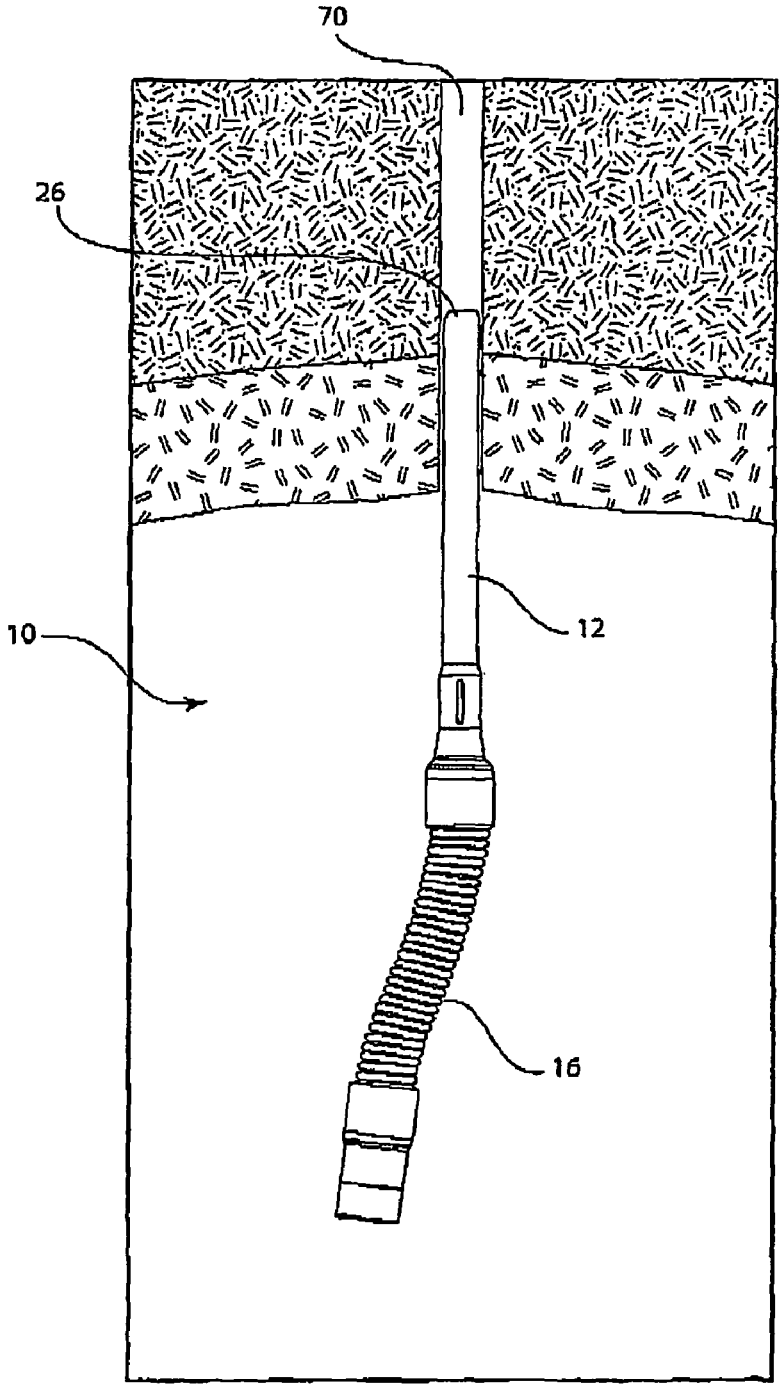

FIGS. 6*a* and 6*b* show the advantages of the absorbing and lateral movement of the nozzle when mis-alignment is taking place as part of the rock bolting configuration.

Figure 7:
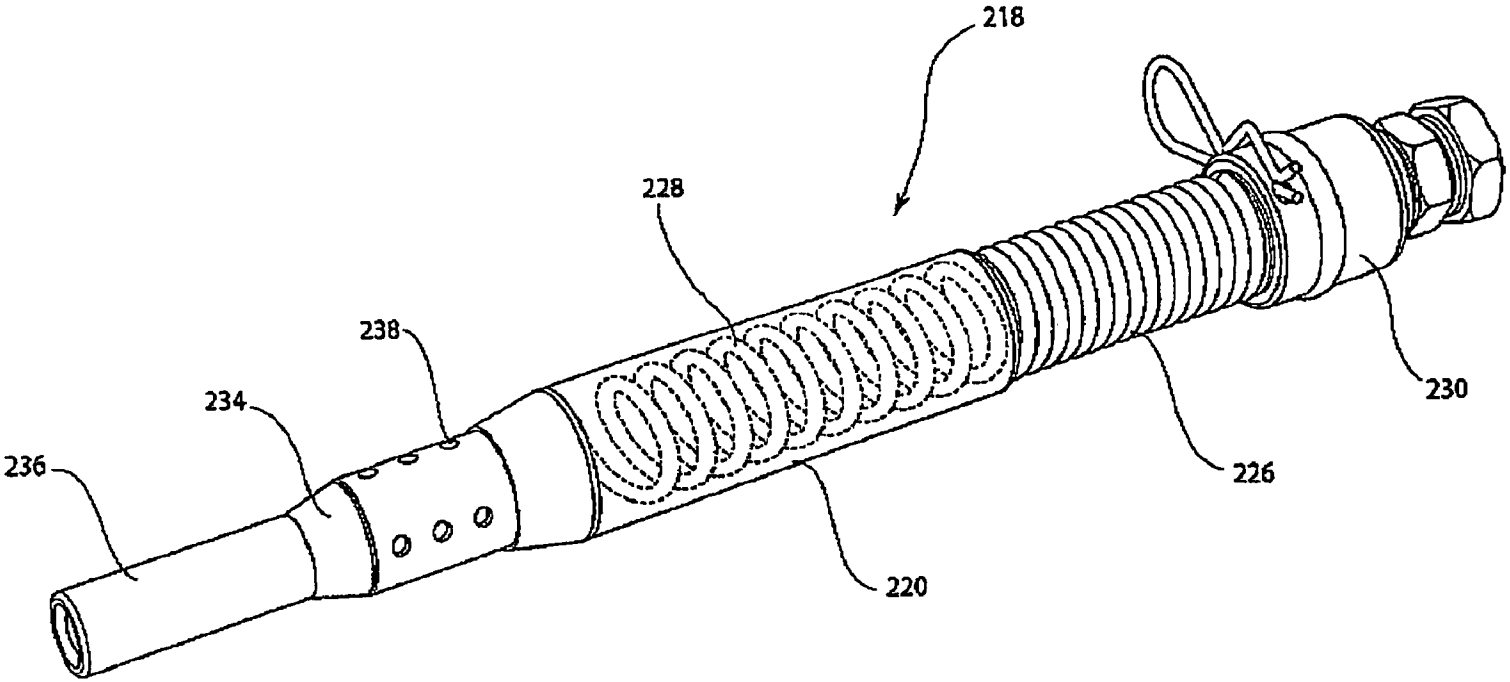
Figure 8:
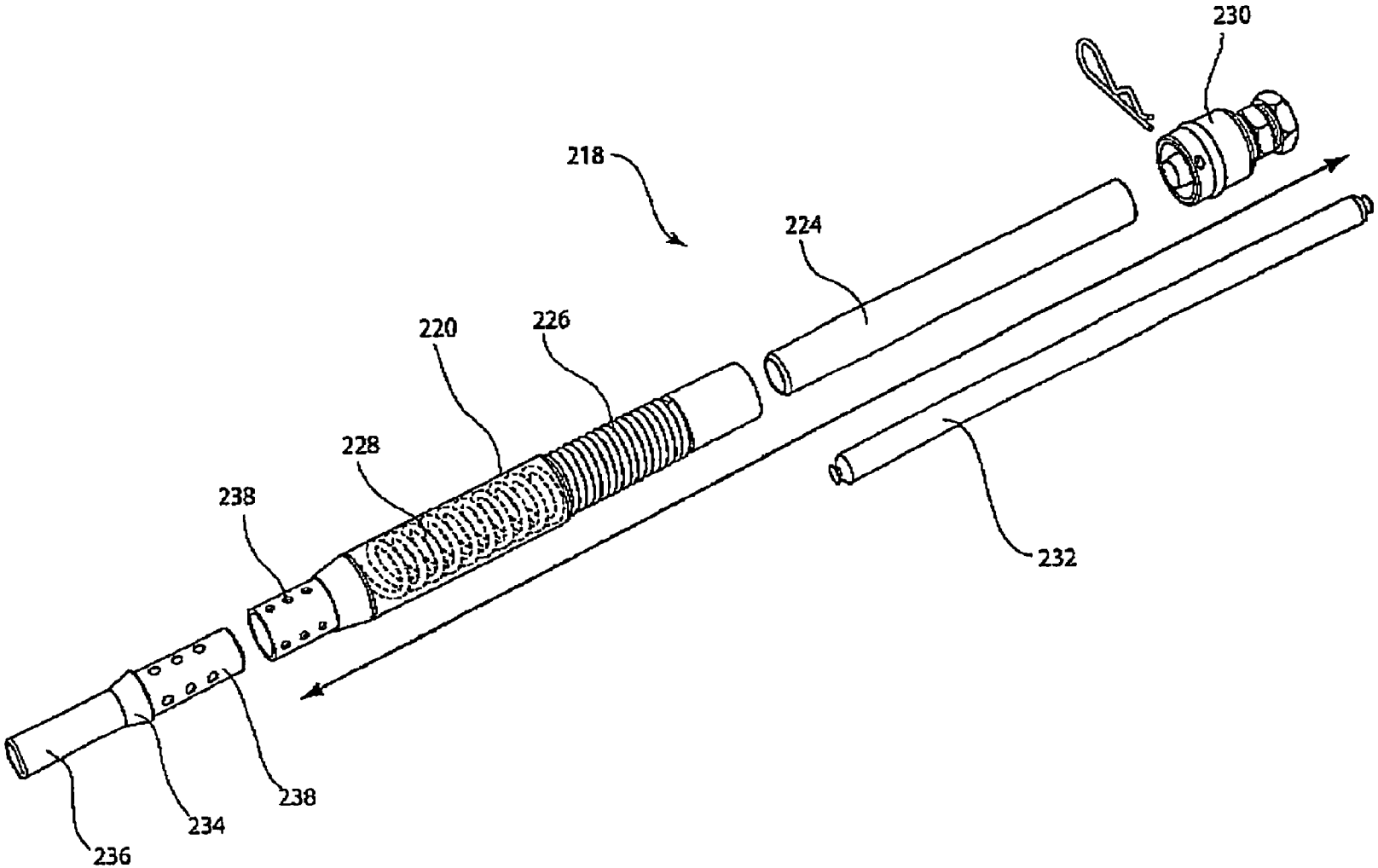
Figure 9A:
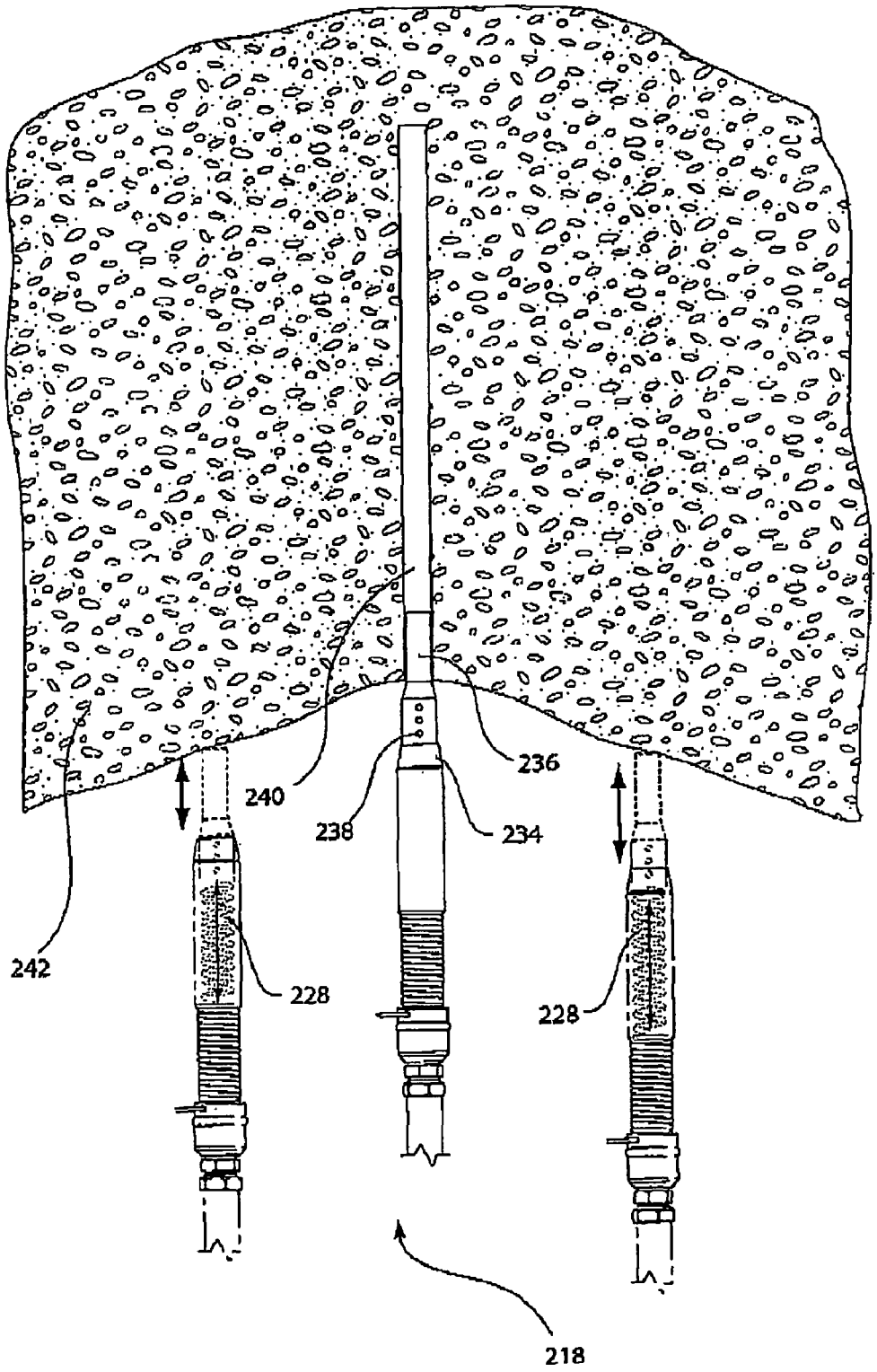
Figure 9B:
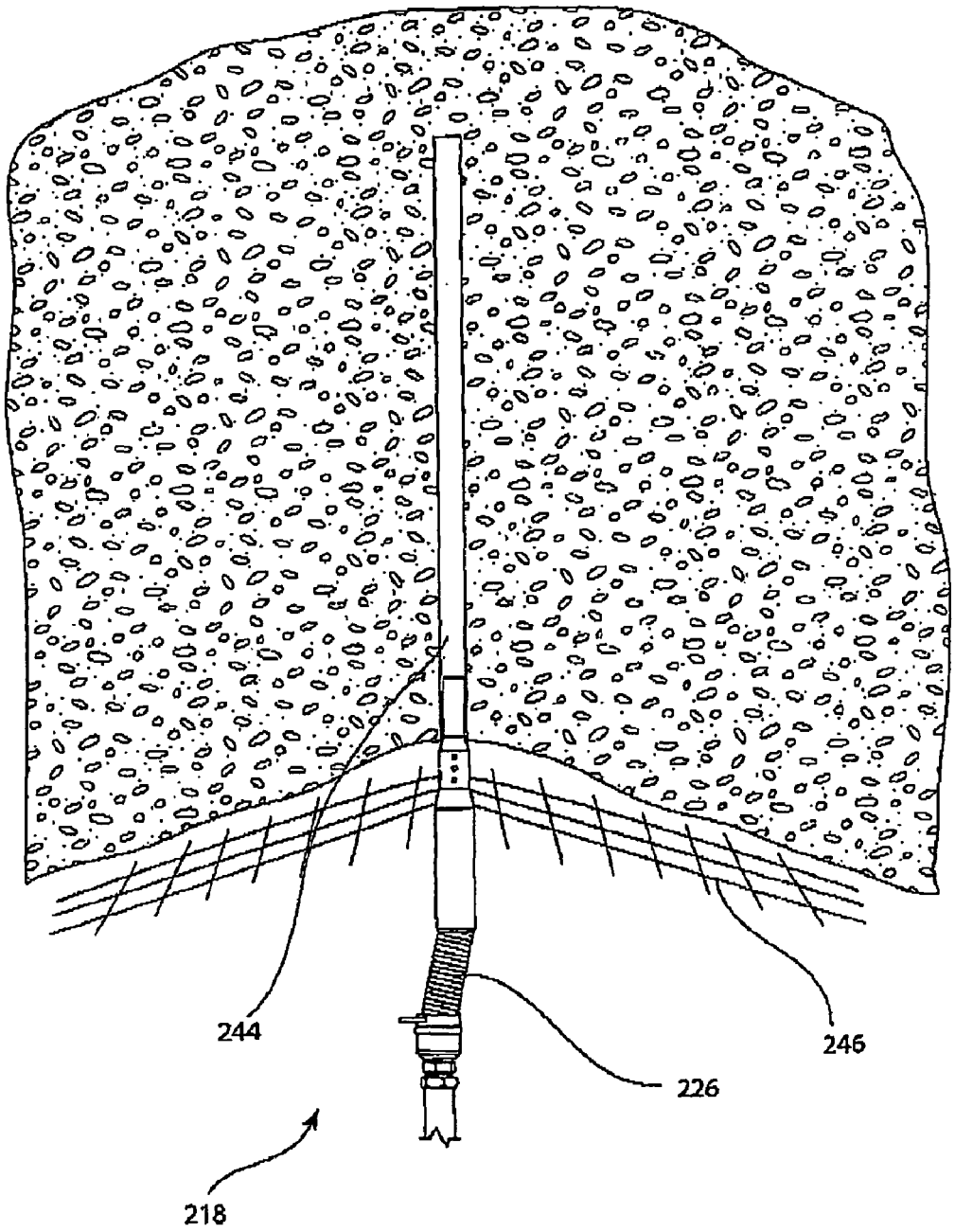

FIG. 7 is a perspective view of a further preferred form of the invention for the resin nozzle adapted to insert the resin sausages into the pre drilled hole of the rock to be reinforced;

FIG. 8 shows the components that are utilized in providing for the nozzle in this preferred form of this invention;

FIGS. 9*a* and 9*b* respectively show the advantageous features of the compression spring in absorbing impact when misalignment is taking place and also advantageous features of the tension spring which provides for lateral flexible side movement when an alignment requires passing through a mesh or the like which has been employed as part of the rock bolting configuration in this further form of the invention.

DETAILED DESCRIPTION OF THE DRAWINGS

Referring to the drawings now in greater detail and firstly the nozzle 10 and its main structural components. The nozzle 10 includes a main body spring 16, which at one end is mated to a nose cone 14, with the nose cone 14 then attached to the nozzle tip 12. The main body spring 16 at the other end is then attached to an adaptor 18 of which a boss 20 is connected thereto. An inner plastic guide tube 22 is then insert able up through the boss and adaptor into the main body spring.

Figure 1:
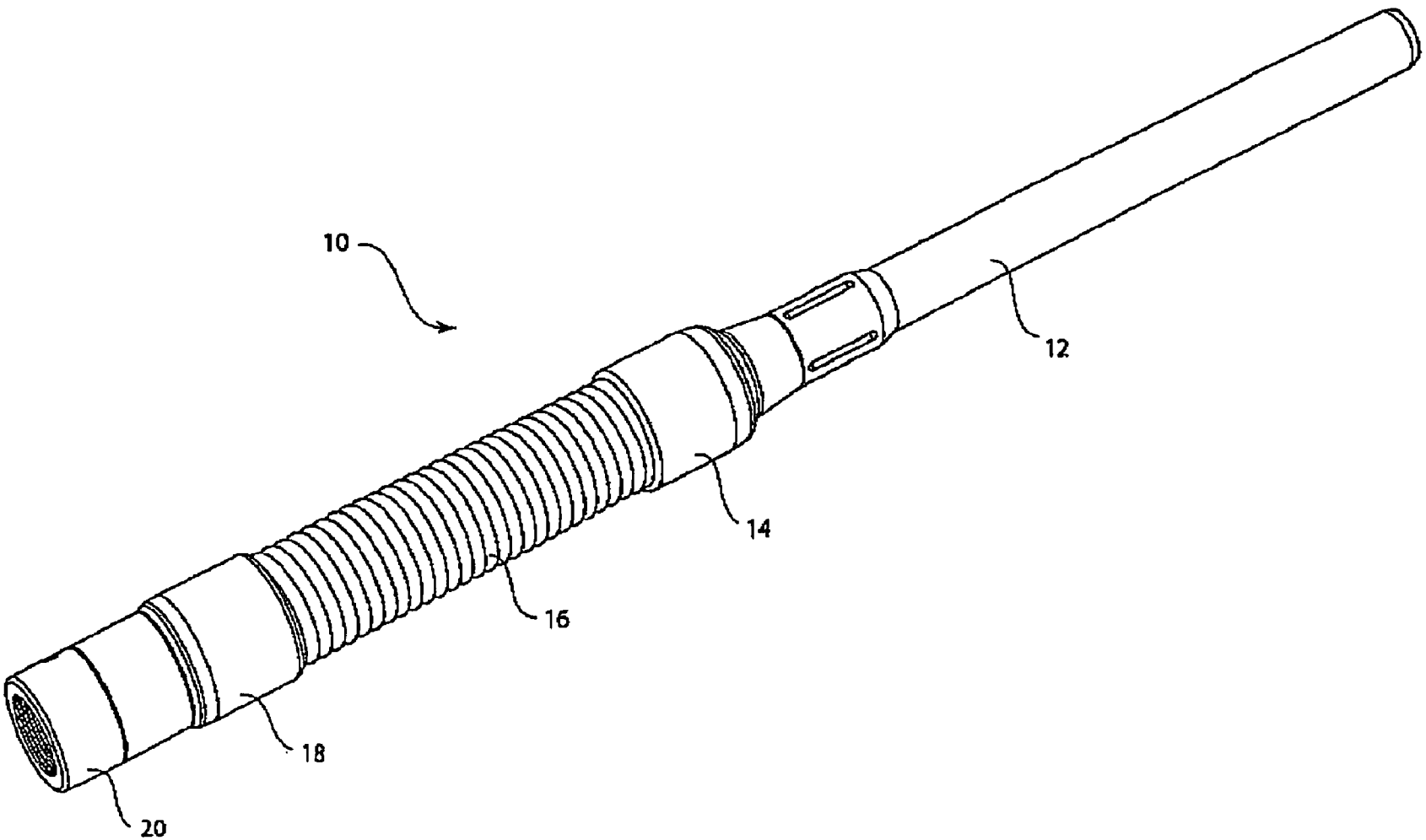
FIG. 1 shows a perspective view of the nozzle arrangement in one preferred embodiment of the invention.
Figure 2:
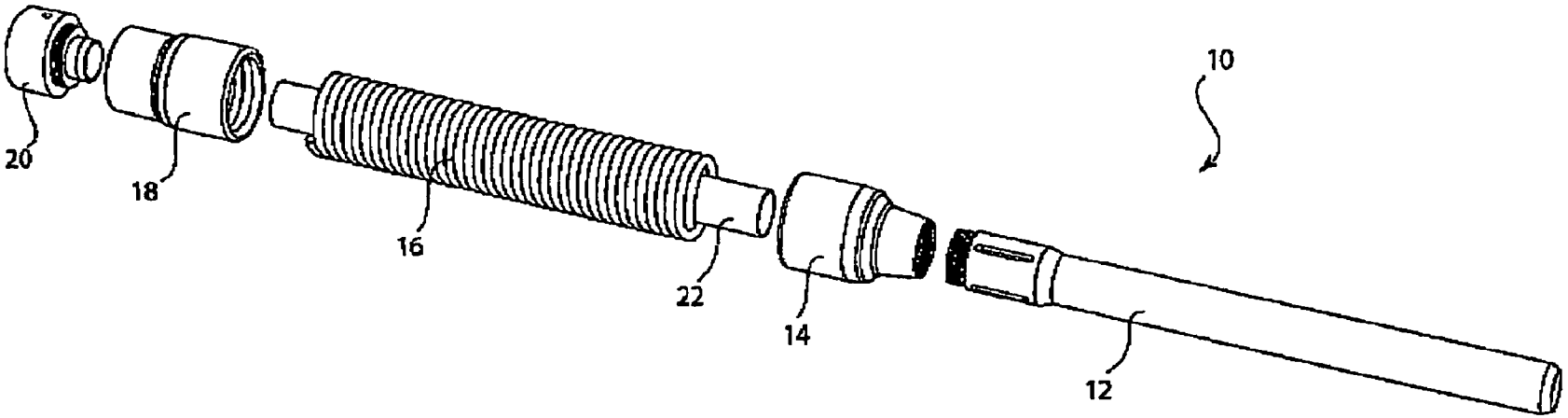
FIG. 2 is an exploded view of FIG. 1 detailing the major structural components of the nozzle in this preferred embodiment of the invention.
Figure 3:
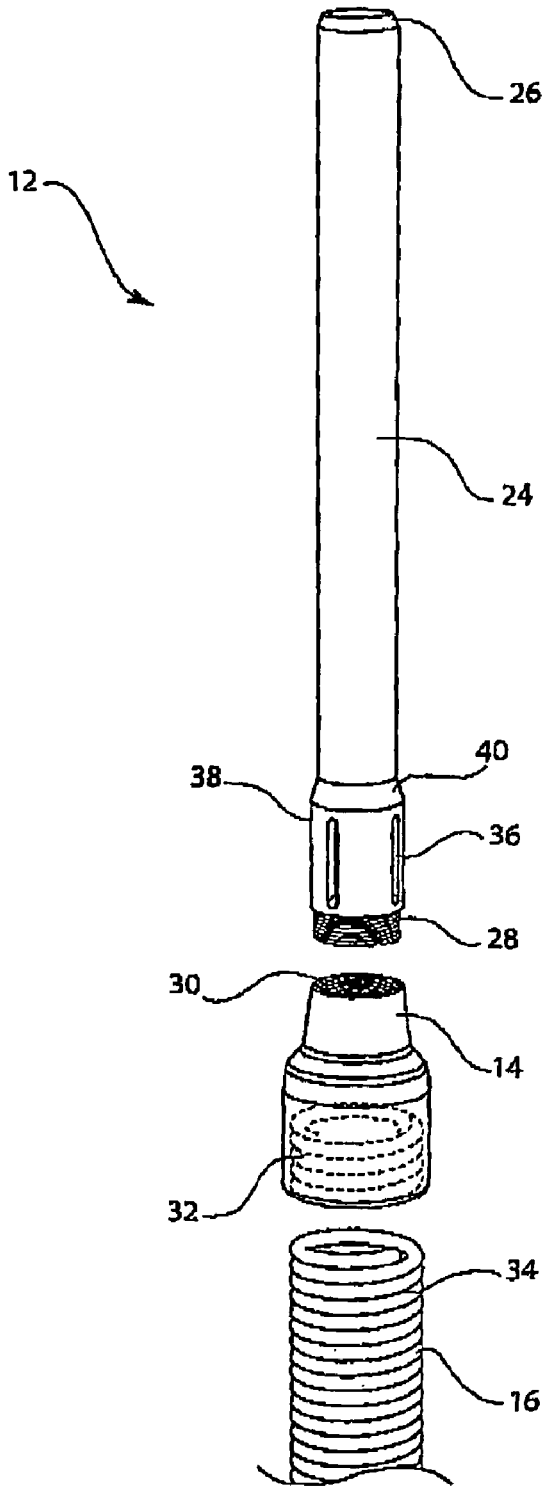
FIG. 3 shows exploded perspective view of the nose cone interconnecting with the nozzle tip and the main body spring.

Referring to FIG. 3, the nozzle tip 12 includes a main cylindrical column 24, which terminates in a tapered edge 26. The length of the cylindrical column 24 would be of the dimensions adequate enough for the nozzle tip to extend through adequately into the pre-drilled holes. The tapered edge 26 of the nozzle tip allows the leading edge of the nozzle tip 12 to locate the collar of the hole more conveniently and efficiently.

Advantageously by having the cylindrical column 24 and also the tapered edge 26 will allow the nozzle tip to slide conveniently up into the hole and also to a length within the pre-drilled hole beyond that area of rock which could be slightly fractured or broken during the pre-drilling of the hole.

Advantageously by having the nozzle tip column 24 extending well into the pre-drilled hole is able to by-pass any of the this fractured or damaged rock, such that if and when the resin sausages are injected into the hole, they do not come into contact with this fractured and damaged rock which could inadvertently release the resin into the crack, rather than up into the hole.

The nozzle tip 12 and the nose cone 14 interconnect respectively through a mating arrangement shown as 28 and 30. The turns or winds of these threaded mating pattern 28, 30 of the respective nozzle tip 12 and nose cone 14, means that the wide thread provides for easy assembly and also cleaning of the components.

For example, if resin becomes lodged within the threads, given there is a wide thread arrangement this resin can be easily cleaned off. Wide threads can also provide the opportunity that within three or four turns the nozzle tip can be locked and secured onto the nose cone 14.

The nose cone 14 also has in a thread 32 which is of the dimensions the same as the turns or winds 34 of the spring 16. Advantageously by making the inner thread the same dimensions as the turns or winds of the spring 16 means that the nose cone can be conveniently secured and fastened onto the main body spring 16.

Advantageously there is no requirement for extra fastening structural features. The spring, nose cone and nozzle tip can all be quickly and easily interconnected.

In this particular embodiment there are four vertical slots 36 that extend around the circumference of the chamber 38 of the nozzle tip 12. These vertical slots are designed to exhaust air pressure and not to interfere with the resin sausage capsules as they pass through the nozzle arrangement. Each slot 36 includes chamfering of its edges in a direction of flow.

Advantageously this chamfering of the edges of the slots means that as the resin sausages are passing through the nozzle tip, they are not inadvertently ruptured by making contact with a sharp edge or the like.

There is a slight tapering 40 of the circumferential rib 38 of the main base chamber for the nozzle tip. This tapering 40 of the edges where the slots are located prevents the nozzle tip being pushed too far into the pre-drilled bolt hole and blocking off the exhaust slots which may cause the resin capsules to rupture.

Figure 4:
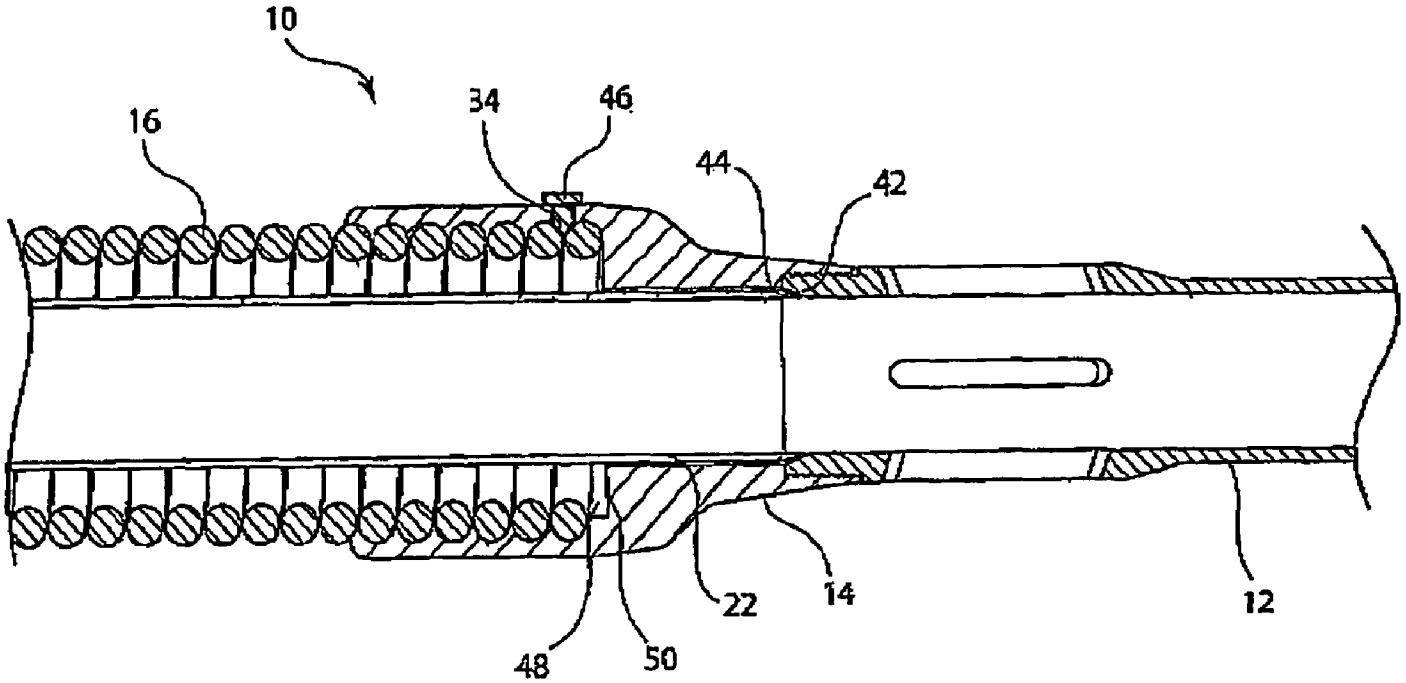
FIG. 4 is a cross sectional view of FIG. 3.

Referring to FIG. 4, it can be seen at 42 a slight taper at the base of the tip inside the nozzle tip 12. This tapering 42 allows the inner plastic guide tube 22 and the corresponding tapered edge 44 of the inner guide tube to match up ensuring smooth transition of the resin sausage capsules passing through the main body spring into the nozzle tip.

When the nozzle cone 14 is secured on the main body spring 16, a spring lock bolt 46 can be inserted in-between the windings 34 of the main spring 16 thereby offering additional securing of the main body spring 16 with the nose cone. The nose cone includes its bore hole 48 which provides almost like a barrel inside the nose cone 14 just below the nozzle tip thread which guides the inner plastic tube 22 to ensure a good fit in the taper at the base of the tip, and also acts as a slide for when lateral flex occurs in the spring 16, the guide is then able to slide back.

As illustrated in this arrangement the barrel 48 may act as a guide for the resin to pass through and into the tip which then guides the plastic inner tube 22 back to the original position when straight again, ensuring a good fit against taper of the tip. The barrel 48 ends in shoulder 50, which prevents the spring 16 winding any further up into the nose cone.

The main body spring 16 provides a flexible back bone for the complete nozzle arrangement 10 and a flexible outer sheet for the inner plastic guide tube 22.

Referring to FIGS. 6*a* and 6*b*, if the nozzle tip 12 has located the collar of the pre-drilled hole, but will not go up into the hole, a movement from an operator left or right or forward will re-align the nozzle tip without the whole rock bolting equipment having to be perpendicular to the hole. Advantageously the main body spring 16 will flex into a "C" shape or an "S" re-aligning the nozzle tip allowing it to slide into the hole thereby allowing the resin sausage capsules to then be able to be fired into the hole.

The adaptor 18 also includes a threaded relationship between the main body spring 16. Threads 32 are of the same dimensions as the turns or winds 34 of the main spring 16. A hub screw can be inserted onto the winds 34 of the main spring 16 in order to secure it in place. The adaptor 18 also includes a shoulder 19 to which the main spring 16 can rest thereon and be contained within inside the housing or casing of the adaptor 18.

Located under the main shoulder 19 is tapered edge 57 which includes therein, a thread pattern 56 which mates with the threaded pattern 54 of the boss member 20, such that the boss member 20 can be fastened by a screw thread arrangement with the adaptor member 18. The outer surface of the adaptor member 18 may include a series of holes or depressions to which confirm fixing points for a C spanner which would enable the operator to easily screw and unscrew the relative components.

Figure 5:
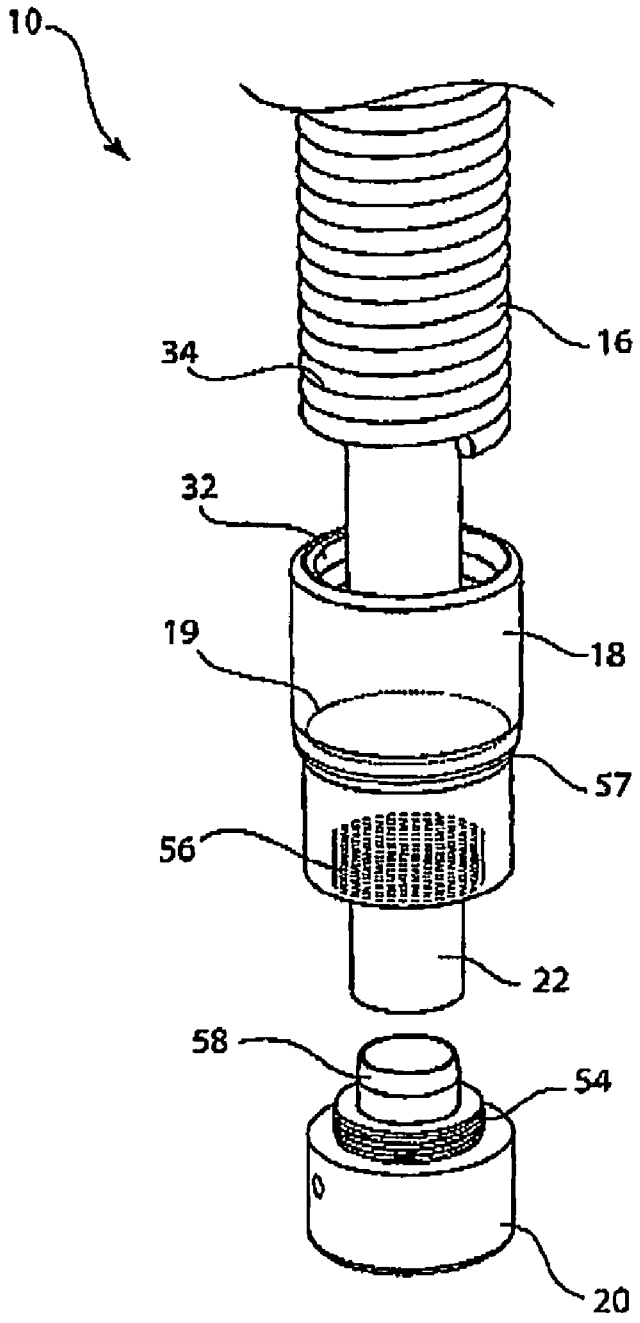
FIG. 5 is a part view, slightly exploded of the adaptor and boss to which assists in securing the nozzle onto the equipment responsible for injecting the resin sausages.

The boss member 20 is at the base of the nozzle arrangement 10 with its purpose to serve as a mount point for the inner plastic tube 22 which is pushed up over a hollow taper, shown in FIG. 5 as 58. The boss 20 and the adaptor 18 are then screwed together by virtue of the corresponding mating threads 56 and 54.

The plastic inner tube guide 22 may then be pushed over a spigot of the boss, which is wedged into place as the two components become fastened together. This interconnection between the boss and the adaptor holds the inner tube in place and if required for a quick change-over, four drill holes can be placed around the body to once again allow the C spanner to tighten and loosen the boss with the adaptor. The bottom side of the hollow taper 58 has an inverted taper at the top of the thread.

In certain arrangements of rock bolting this may then be screwed on to a 20 hydraulic nipple which will hold the arrangement in place on the equipment responsible for carrying out the rock bolting and injecting the resin sausage capsules into the nozzle arrangement 10.

In FIG. 6*a* the nozzle arrangement 10 is inserted into a pre-drilled hole 70 up through the rock substrate 72. The spring 16 will flex into a "C" shape, which realigns the nozzle tip allowing to slide into the pre-drilled hole 70. As the nozzle tip 12 has been able to realign itself well up into the pre-drilled hole 70, the resin sausage capsules can then be correctly injected or fired up into the pre-drilled hole 70.

FIG. 6*b* presents a similar arrangement to the situation in 6*a* however in this illustration there is a general flexing of the main spring 16 into a S shape and the subsequent realigning of the nozzle tip 12 allowing it then to slide into the pre-drilled hole 70.

FIGS. 7 to 9 shows a further preferred embodiment of a nozzle for this invention wherein the nozzle 218 includes a main body 220 which provides for a passage to which guide 224 can be therein placed laterally enclosed by the windings of both the tension spring 226 and the compression spring 228.

The nozzle 218 also includes a conventional connector 230 to which can be attached to the main hydraulic or driving pumping mechanism to which provides the force for the resin sausages 232 to be inserted into the pre drilled holes. The main body also includes a tapered shoulder 234 and a terminating funnel 236.

It is the terminating funnel portion 236 which is in fact inserted into the pre drilled hole. Tapered shoulder or portion 234 separates the series of exhaust holes 238 that allow any created back pressure associated with the forcing up of the resin sausages 232 in the pre drilled hole to be taken away.

If the operator inadvertently positions the nozzle 218 and rather than inserting it into the pre drilled hole 240, in fact makes impact to the rock, the compression to spring 228 is able to absorb impact and no kinks or deformation takes place on the nozzle 218, which means that it need not be replaced if the operator makes an incorrect positioning during the alignment.

The tension spring 226 assists the nozzle in being correctly aligned and insertable into the pre drilled hole 244 even though there is a mesh 246 present. The lateral effect provided for by the tension spring 226 means that if the mesh 246 partially covers up the pre drilled hole, the nozzle 218 is still able to be located in order for the resin sausages to be then inserted there into the pre drilled hole.

The invention claimed is:

1. A resin nozzle for use in conjunction with rock bolting equipment adapted to inject a resin sausage through the resin nozzle and into a pre-drilled bolt hole, the resin nozzle including:

a connector member adapted to be fastened onto the rock bolting equipment;

a spring that defines a guide tube passage holding a guide tube, said guide tube defining a sausage passage adapted to receive resin sausages passed therethrough by the rock bolting equipment;

a nozzle tip providing a cylindrical conduit structured to extend into the pre-drilled bolt hole, said cylindrical conduit defining an exit passage; and a nose cone joining said spring to said nozzle tip such that said sausage passage and said exit passage mate to provide a smooth transition for a resin sausage passing from said sausage passage to said exit passage, such that a resin sausage driven by said rock bolting equipment will be ejected from the resin nozzle, through said sausage passage and said exit passage.

2. The resin nozzle of claim 1, wherein said spring is longitudinally wound and mounted to said connector member so as to flex and deflect radially outwardly in all directions.

3. The resin nozzle of claim 2 wherein said nozzle tip is adapted to eject a resin sausage when the spring is either flexed or unflexed.

4. The resin nozzle of claim 3 wherein said nozzle tip is joined to said spring, through said nose cone, by mating threads.

5. The resin nozzle of claim 3, wherein the nozzle tip is adapted to eject a resin sausage when the spring is flexed in an "s" or "c".

6. The resin nozzle of claim 1 wherein said guide tube is a reinforced plastic tube.

7. The resin nozzle of claim 1 wherein said nozzle tip includes a tapered section structured to assist in the alignment of said cylindrical conduit of said nozzle tip, and not said spring, into the pre drilled bolt hole.

8. The resin nozzle of claim 7 wherein said tapered section is defined in part by a cylindrical shoulder and contains a series of holes adapted to exhaust back pressure as a resin sausage is injected through the resin nozzle and into a pre-drilled bolt hole, said tapered section adapted to prevent said series of holes from being blocked by the pre drilled bolt hole.

9. The resin nozzle of claim 8 wherein said series of holes are vertical slots.

10. The resin nozzle of claim 9 wherein said vertical slots are structured so as to not interfere with a resin sausage as it passes through said nozzle tip, with said slots chamfered at their edges in the direction of flow of the resin sausages.

11. The resin nozzle of claim 1, wherein said spring includes a compression spring portion, said compression spring portion adapted to absorb impact in axial directions along the axis of said compression spring portion when said nozzle tip inadvertently collides with rock or related material during alignment of said nozzle tip with pre drilled bolt hole; and said spring further includes a tension spring portion that is flexible in radial directions perpendicular to the axis of said tension spring portion.

* * * * *